United States Patent [19]

Stahlecker

[11] Patent Number: 4,947,633

[45] Date of Patent: Aug. 14, 1990

[54] PROCESS AND AN ARRANGEMENT FOR PRODUCING PACKAGES TO BE USED AS FEEDING PACKAGES FOR TWISTING

[75] Inventor: Fritz Stahlecker, Bad Uberkingen, Fed. Rep. of Germany

[73] Assignee: Hans Stahlecker, Fed. Rep. of Germany; a part interest

[21] Appl. No.: 311,731

[22] Filed: Feb. 17, 1989

[30] Foreign Application Priority Data

Feb. 20, 1988 [DE] Fed. Rep. of Germany ..... 3805338

[51] Int. Cl.[5] ..... D01H 1/115; D01H 13/16; B65H 63/024

[52] U.S. Cl. ..... 57/86; 57/80; 57/261; 57/328; 242/38

[58] Field of Search ..... 57/80–87, 57/261, 263, 328; 242/38, 42

[56] References Cited

U.S. PATENT DOCUMENTS

| | | | |
|---|---|---|---|
| 1,995,730 | 3/1935 | Abbott | 242/38 |
| 2,093,628 | 9/1937 | Abbott | 242/38 |
| 2,740,591 | 4/1956 | Woods | 242/38 |
| 4,444,005 | 4/1984 | Klein et al. | 57/87 X |
| 4,505,099 | 3/1985 | Fukunaga et al. | 57/86 |
| 4,790,130 | 12/1988 | Stahlecker et al. | 57/328 X |

*Primary Examiner*—John Petrakes

*Attorney, Agent, or Firm*—Evenson, Wands, Edwards, Lenahan & McKeown

[57] ABSTRACT

In a process for producing packages used as feeding packages for twisting, onto which two prestrengthened yarn components are wound side-by-side as a double yarn, it is provided that, when one of the two yarn components breaks, the other yarn component is cut in such a manner that the lengths of the two yarn components are at least approximately the same. As an alternative, it is provided that, when one yarn component breaks, the partially completed package is stopped, before the broken end has moved onto the partially completed package.

22 Claims, 2 Drawing Sheets

PROCESS AND AN ARRANGEMENT FOR PRODUCING PACKAGES TO BE USED AS FEEDING PACKAGES FOR TWISTING

BACKGROUND AND SUMMARY OF THE INVENTION

The invention relates to a process for producing packages used as feeding packages for twisting, onto which two prestrengthened yarn components are wound side-by-side as a double yarn, two yarn components, in each case, passing through a drafting unit and a false-twisting device behind the drafting unit. The two yarn components are subsequently guided together and wound onto a spool as a double yarn to form a package, and in the event of a breakage of one yarn component, the other yarn component is cut. The invention also relates to an arrangement for producing packages used as feeding packages for twisting using this process.

In a known arrangement (German Published Examined patent application Ser. No. DE-A 36 06 932), it is endeavored to have only double yarns move onto the spool to form a package. For this purpose, it is provided that, in the event of a breakage of only one yarn component, the other yarn component is cut also. Preventing that only one yarn component moves onto the spool and is wound up in the yarn package is extremely important in practice. Since the two yarn components of the double yarn, which are to be wound up side-by-side, practically have no mutual bond, the ends of the two yarn components, which are not located in the same position on the partially completed package, must then be searched for and picked up. This searching alone causes considerable problems. There is also the additional problem that in cases where as little as a difference of one package winding exists between the end of the two yarn components, i.e., one yarn component is longer by a corresponding package circumference length, it will no longer be possible to withdraw the two yarn components together and have them available for a piecing process. The searching and withdrawing therefore represents a problem even for manual piecing, but an automatic piecing machine would encounter problems which can hardly be solved.

An object of the invention is to provide a process and an arrangement by means of which it can be very reliably prevented that a single yarn is wound into the package by itself.

This object is achieved according to preferred embodiments of the invention in that, when one yarn component breaks, the cutting is carried out in such a manner that the lengths of both yarn components are at least approximately the same.

This results in that only one double yarn is located on the partially completed package so that the end of which, i.e., the ends of both yarn components, can be found and withdrawn in a relatively simple manner.

In a development of especially preferred embodiments of the invention, it is provided that, when one yarn component breaks, both yarn components, moving ahead of the breaking point in conveying direction, are cut simultaneously at the same distance from the partially completed package. As a result, it is achieved that both yarn components are still cut at the same point and at the same distance from teh partially completed package when only one yarn component breaks, so that the ends of both yarn components and thus of the double yarn will also be located at the same point of the partially completed package.

In a further development of the invention, it is provided that, when one yarn component breaks, the still existing double yarn is cut which is downstream of the breaking point of this yarn component in the travel direction of the yarn. This permits the use of only one cutting device.

In another solution according to the invention, which, under certain circumstances, may be used together with the above described solution, it is provided that the partially completed package is stopped before the broken end has moved onto same if one yarn component breaks. It will then be possible to find the ends of both yarn components and to withdraw the double yarn for a piecing process, even when these ends have different lengths.

In a further development of preferred embodiments of the invention, for the same purpose, in the case of an arrangement for producing packages which are used as feeding packages for twisting, onto which the two prestrengthened yarn components are wound side-by-side as a double yarn, having two drafting units arranged next to one another, having false-twisting devices which follow, having withdrawal devices, having devices for the guiding-together of the yarn components and for the winding of the yarn components onto a spool, and having devices which, when one yarn component breaks, cut the other yarn component, one or two cutting devices are provided which are connected behind yarn guards in the travel direction of the yarn and are controlled by the yarn guards in such a manner that the broken yarn component and the other yarn component have approximately the same length.

In this last mentioned development, it is advantageous for the yarn guards to be arranged directly behind the false-twisting devices. As a result, it becomes possible to detect a breakage relatively early in the course of the yarn and to react to it. In an expedient development, a joint cutting device is provided which is arranged in the course of both yarn components. As a result, it becomes possible to cut the two yarn components of the yarn structure, which is then still moving along as a double yarn, so that they definitely have the same length.

In order to have as much time as possible for a reaction, it is advantageous for the cutting device to be arranged directly in front of the spool forming the package. However, in this case, the fact must be taken into account that the yarn carries out a traverse motion in this area. So that no traverse motion has to be taken into account or at most one which is signficantly smaller, it may be provided in another solution of the invention that the cutting device is arranged in the area of a stationary yarn guiding element of the double yarn.

In a further development of preferred embodiments of the invention, a suction device for the cut-off pieces of the yarn components is assigned to the cutting device. The unbroken yarn component can enter into this suction device after the cutting so that, for a piecing operation, only the broken yarn component must be entered into the false-twisting device.

In another solution of the invention, it is provided that devices for the immediate stopping of the partially completed package are assigned to the devices for the winding-up of the double yarn, these devices for the immediate stopping of the partially completed package being controlled by two yarn guards which are each assigned to one of the yarn components. In this case, under certain circumstances, the unbroken yarn component may not have to be cut and must only be sucked off by means of the suction device for just so long until a piecing process for the broken yarn component is carried out.

Other objects, advantages and novel features of the present invention will become apparent from the following detailed description of the invention when considered in conjunction with the accompanying drawings.

DETAILED DESCRIPTION OF THE DRAWINGS

Figure 1:
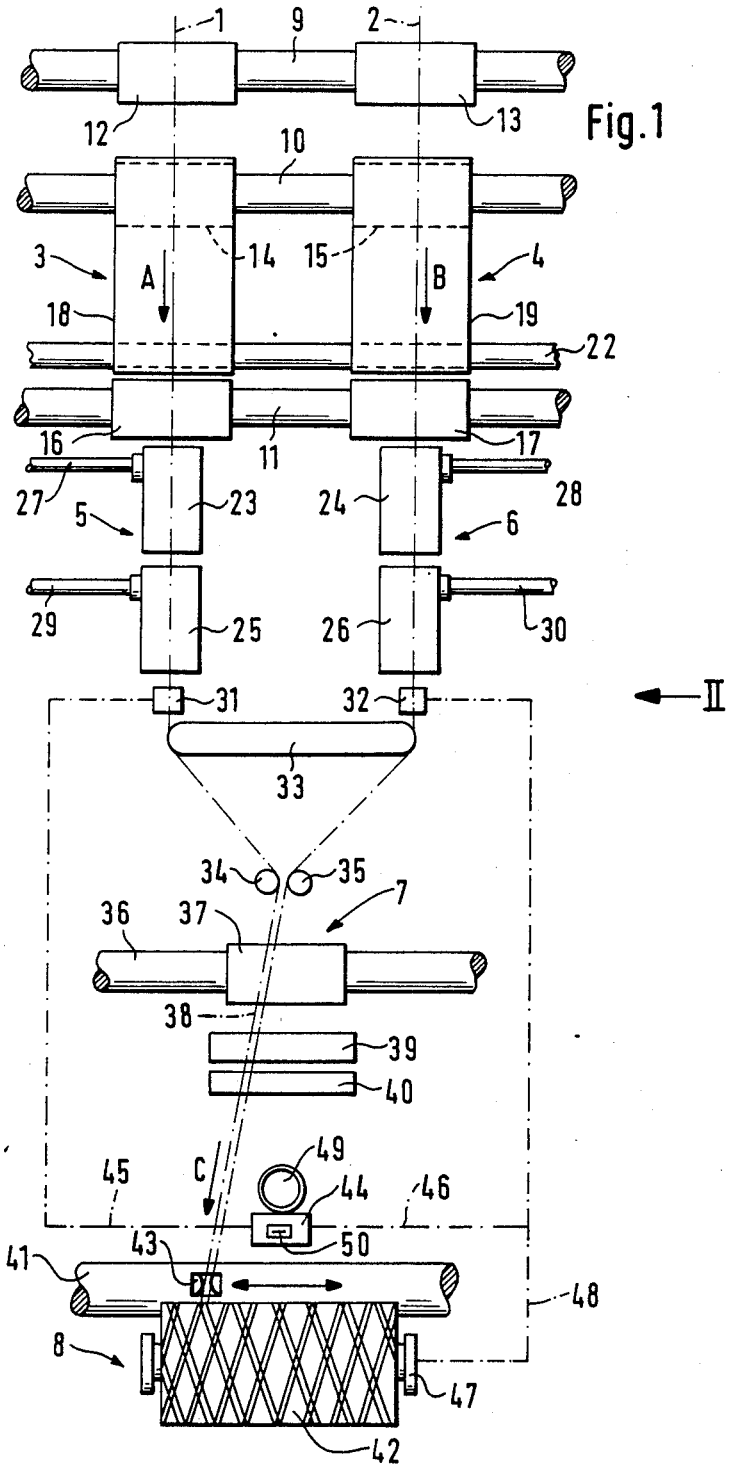
FIG. 1 is a front view of an arrangement according to the invention.

The drawing shows only one arrangement. It should be pointed out, however, that this arrangement is part of a machine which consists of a plurality of arrangements of the same type which are disposed next to one another in preferred embodiments of the invention.

In the case of the shown arrangement, two yarn components 1, 2 are first fed as slivers into two drafting units 3, 4, which are arranged next to one another and extend in parallel to one another, in which they are drawn to the desired yarn size. The two yarn components 1, 2 move through the arrangement in the direction of the arrow (A or B). Behind the drafting units 3, 4, the yarn components 1, 2 enter into false-twisting devices 5, 6, after which they are guided together and are withdrawn by a withdrawal device 7 as a double yarn 38. The double yarn 38 moves in the direction of the arrow (C) to a wind-up device 8 in which the double yarn is wound up on a spool to form a cross-wound package 42.

The drafting units 3, 4 have joint bottom cylinders 9, 10, 11, which are driven at the machine end, and to which, in each case, pressure rollers 12, 14, 16 are assigned to drafting unit 3, and pressure rollers 13, 15, 17 to drafting unit 4. In the shown embodiment, three-cylinder drafting units are provided. Naturally, different drafting units may also be used. The drafting units 3, 4 each contain top aprons 18, 19 and assigned bottom aprons 20, 21. Also, if additional pairs of drafting rollers are present, additional apron guides may be provided. The bottom aprons 20, 21 are guided around a deflecting rail 22.

The false-twisting devices 5, 6 each consist of two air nozzles 23, 25; 24, 26 arranged behind one another. The air nozzles 23, 25 are connected to compressed-air lines 27, 29, and the air nozzles 24, 26 are connected to compressed air lines 28, 30. The respective first air nozzles 23, 24 of the false-twisting devices 5, 6 are constructed as suction nozzles which provide the yarn components 1, 2 with no twist or with practically no twist. Air nozzles 25, 26, which follow, in a known manner, are constructed as false-twisting nozzles which provide the yarn components 1, 2 with a false twist.

The false twist, which is given to the yarn components 1, 2, extends back against the moving directions (A, B), to the drafting units 3, 4, so that the yarn components 1, 2, in this area have a relatively high stability and are protected with respect to breakage. However, the false twist opens up directly behind the false-twisting nozzles 25, 26 so that the yarn components 1, 2 are only prestrengthened. The greatest danger of a yarn breakage exists in this area, so that here, yarn guards 31, 32 are arranged directly behind the false twisting nozzles 25, 26. The function of these yarn guards 31, 32 will be explained later.

Behind the yarn guards 31, 32, the two yarn components 1, 2 are deflected via a yarn guide 33 and are guided toward one another, in which case they are guided by additional yarn guides 34, 35 in such a manner that they move closely next to one another and in parallel to one another. These two yarn guides 34, 35 provide that the two yarn components 1, 2 are closely adjacent to one another and form a double yarn 38. In this case, the two yarn components 1, 2 may possibly be in contact with one another. However, care is taken that they do not wind themselves around one another.

The withdrawal device 7 consists of a shaft 36, which passes through in longitudinal direction of the machine and to which, at each arrangement, a separate pressure roller 37 is assigned for the double yarn 38.

The double yarn 38 moves in the direction of the arrow (C) to a traversing yarn guide 43 which moves to-and-fro in the direction of a double arrow transversely in front of the partially completed package 42. The package 42 is held by means of a package holding device, which is not shown, and is driven by a roller 41 extending in the longitudinal direction of the machine. In order to compensate the traversing motion without exercising unacceptably high tensions on the double yarn 38, compensating elements in the form of a deflecting guide 39, 40 consisting of two rollers are provided between the withdrawal device 7 and the wind-up device 8. In this case, the roller 39 is driven to perform a movement directed transversely to the movement of the yarn, synchronously with respect to the traversing yarn guide 43 (see Position 39', FIG. 2).

As explained, it is important in practice that it is prevented that, when one of the two yarn components 1 or 2 breaks, the other yarn component is wound up alone even over only a relatively short length. Otherwise, particularly during automatic piecing, it would be very difficult to find the two ends of the yarn components 1, 2 on the partially completed package 42 and to withdraw them jointly as a double yarn against the wind-up direction from the partially completed package 42 for a piecing operation.

In order to prevent that even a short piece of a single yarn component 1, 2 is wound onto the package 42, a cutting device 44 is arranged in the area in front of the traversing yarn guide 43, this cutting device 44 being connected by means of lines 45, 46 to both yarn guards 31 32 and being actuated in the event of a breakage of one of the two yarn components 1, 2. In the embodiment shown, the cutting device 44 has a blade 50, which is sharpened on both sides and which, when one of the two yarn components 1, 2 breaks, is moved out and is moved into the area through which the double yarn 38 passes during the traversing motion. The traversing yarn guide 43 will then apply the double yarn 38 to the blade 50 so that the double yarn 38 is cut. In this case, the response times are such that, when one of the two yarn guards 31, 32 detects a breakage of one yarn component 1, 2, the actuating of the cutting device 44 is carried out so fast that the cutting of the double yarn 38 takes place while it is still present as a double yarn 38. In order to ensure, despite the relatively large traversing motion, that the double yarn 38 reaches the cutting device 44 as fast as possible, it may be provided, as a modification of the shown embodiment, that a blade is provided which extends over the whole traversing width or several individual blades are provided which are moved out correspondingly.

In front of the cutting device 44, a suction device 49 is arranged into which the double yarn 38 is sucked after the cutting. The remaining yarn piece of the broken yarn component 1, 2 as well as the unbroken yarn component enters into this suction device. It may be provided that the yarn guards 31, 32, also in the area of the drafting units 3, 4, actuate a sliver stopping device so that the supply of fiber material is interrupted until the piecing process is carried out. However it may also be provided that, up to the time a piecing operation is carried out, the fiber material continues to move through the drafting units 3, 4, in which case, the broken fiber component enters into a suction device, which is not shown and is connected behind the drafting unit, while the unbroken yarn component enters the suction device 49 as a prestrengthened yarn. In this case, for a piecing operation, the broken yarn component only has to be returned by means of the air nozzles 23, 25 or 24, 26.

Figure 2:
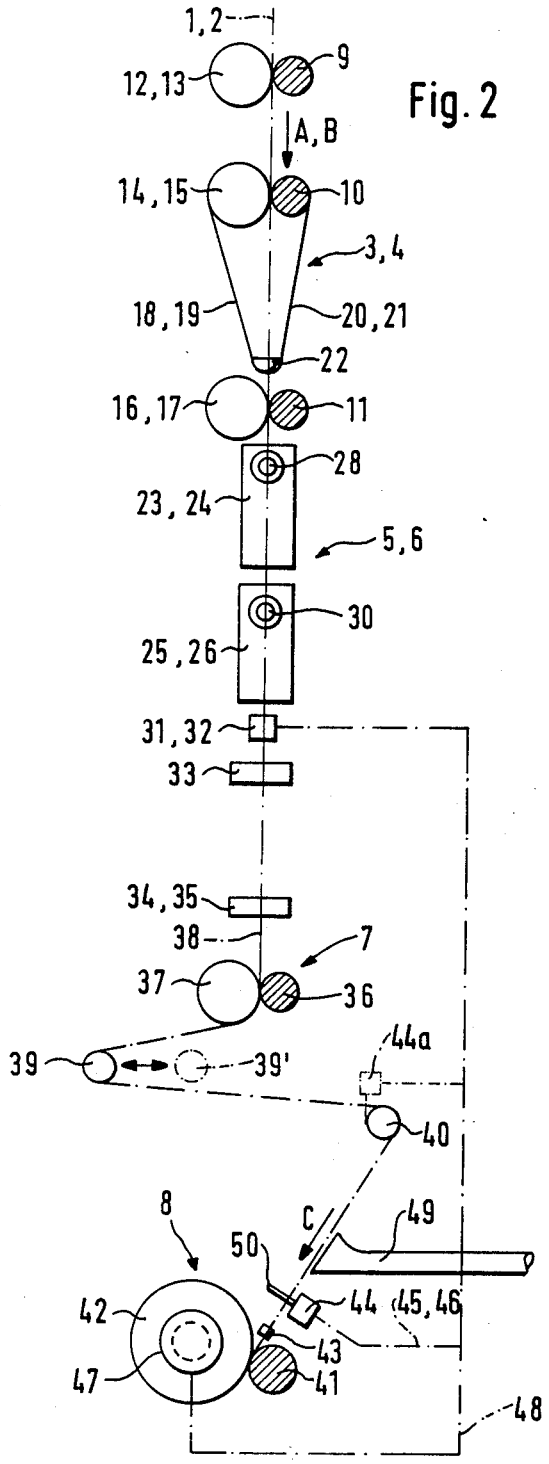
FIG. 2 is a lateral view in the direction of the Arrow II of the arrangement according to FIG. 1.

In a modified embodiment, which is shown in FIG. 2, a cutting device **44*a* is arranged in the area of the deflecting guide 39, 40, i.e., in proximity of the stationary deflecting roller 40. In this area, the double yarn 38 does not traverse or traverses with a significantly reduced path, so that the cutting device 44*a* grips and cuts the double yarn 38 earlier. Despite the fact that this yarn cutting device 44*a* is arranged at a smaller distance from the yarn guards 31, 32, a compensation may be obtained by the shortening of the response time of the cutting device 44*a***.

In addition to the cutting of the double yarn 38, when one yarn component 1, 2 breaks, it is provided in the embodiment according to FIG. 1 and 2 that the partially filled spool 42 is stopped immediately after the breakage of a yarn component 1, 2, so that the cutting point of the double yarn 38 is not wound onto the partially completed package 42, but hangs down from it ready to be gripped. For this purpose, an only schematically shown lift-off device 47 is provided which is controlled by means of the yarn guards 31, 32, with which it is connected by means of a control line 48. In addition, a braking device is provided, which is not shown and which becomes operative immediately with the lifting off of the partially completed package 42 from the winding roller 41 and stops it.

When the lift-off device 47 controlled by the yarn guards 31, 32, which is combined with a braking device, is provided, the unbroken yarn component 1, 2, does not have to be cut when the breakage of one yarn component 1, 2 is determined. It will then be expedient for the unbroken yarn component to be sucked into a suction device which may correspond, for example, to the suction device 49.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A process for producing packages for use as feeding packages for a subsequent twisting operation, comprising:

drafting two slivers by passing them through respective drafting units, passing said slivers through respective false twisting devices arranged downstream of said drafting units to thereby form two separate prestrengthened yarn components, winding the two yarn components onto a package side-by-side one another without being twisted together to thereby form a prestrengthened double yarn package for a subsequent twisting operation which will twist the two yarn components together, and selectively cutting said yarn components in the event of breakage of at least one of said yarn components such that the lengths of the two yarn components are at least approximately the same, thereby facilitating location of ends of the yarn components on the package for a subsequent piecing operation.

2. A process according to claim 1, wherein said selectively cutting includes cutting both yarn components simultaneously at substantially the same distance from the package.

3. A process according to claim 2, wherein said selectively cutting includes cutting both yarn components at a position downstream of the location of a breaking point of one of the yarn components.

4. A process according to claim 1, wherein said selectively cutting includes cutting both yarn components at a position downstream of the location of a breaking point of one of the yarn components.

5. Apparatus for producing packages for use as feeding packages for a subsequent twisting operation, comprising:

drafting means for drafting two slivers, false twisting devices arranged downstream of said drafting means to thereby form two separate prestrengthened yarn components, winding means for winding the two yarn components onto a package side-by-side one another without being twisted together to thereby form a prestrengthened double yarn package for a subsequent twisting operation which will twist the two yarn components together, and cutting means for selectively cutting said yarn components in the event of breakage of at least one of said yarn components such that the lengths of the two yarn components are at least approximately the same, thereby facilitating location of ends of the yarn components on the package for a subsequent piecing operation.

6. Apparatus according to claim 5, wherein said cutting means includes means for cutting both yarn components simultaneously at substantially the same distance from the package.

7. Apparatus according to claim 6, wherein said cutting means includes means for cutting both components at a position downstream of the location of a breaking point at one of the yarn components.

8. Apparatus according to claim 5, wherein said cutting means includes means for cutting both components at a position downstream of the location of a breaking point at one of the yarn components.

9. Apparatus according to claim 5, comprising yarn detector means located upstream of the cutting means for detecting the yarn components.

10. Apparatus according to claim 9, wherein the yarn detector means are disposed immediately downstream of the false twisting devices.

11. Apparatus according to claim 5, wherein said cutting means is a joint cutting device disposed in the path of both yarn components.

12. Apparatus according to claim 11, wherein the cutting device has at least one blade which can be moved into the yarn component path in the area of a traversing yarn guide.

13. Apparatus according to claim 12, wherein a suction device for the cut-off pieces of the yarn components is assigned to the cutting device.

14. Apparatus according to claim 11, wherein a suction device for the cut-off pieces of the yarn components is assigned to the cutting device.

15. Apparatus according to claim 5, wherein said cutting means is disposed downstream of the false twisting devices at a location immediately upstream of the yarn package.

16. Apparatus according to claim 15, wherein a suction device for the cut-off pieces of the yarn components is assigned to the cutting means.

17. Apparatus according to claim 5, wherein the cutting means is arranged in the area of a stationary yarn guiding element of the double yarn.

18. Apparatus according to claim 17, wherein a suction device for the cut-off pieces of the yarn components is assigned to the cutting means.

19. Apparatus according to claim 5, wherein a suction device for cut-off pieces of the yarn components is assigned to the cutting means.

20. A process for producing packages for use as feeding packages for a subsequent twisting operation, comprising:

drafting two slivers by passing them through respective drafting units, passing said slivers through respective false twisting devices arranged downstream of said drafting devices to thereby form two separate prestrengthened yarn components, winding the two yarn components onto a package side-by-side one another without being twisted together to thereby form a prestrengthened double yarn package for a subsequent twisting operation which will twist the two yarn components together, and selectively controlling the winding in the event of interruption of at least one of said yarn components such that the packages stop before the interrupted end has moved onto the package, thereby facilitating location of ends of the yarn components on the package for a subsequent piecing operation.

21. Apparatus for producing packages for use as feeding packages for a subsequent twisting operation, comprising:

drafting means for drafting two slivers, false twisting devices arranged downstream of said drafting devices to thereby form two separate prestrengthened yarn components, winding controlling means for winding the two yarn components onto a package side-by-side one another without being twisted together to thereby form a prestrengthened double yarn package for a subsequent twisting operation which will twist the two yarn components together, and selectively controlling the winding in the event of interruption of at least one of said yarn components such that the packages stop before the interrupted end has moved under the package, thereby facilitating location of ends of the yarn components on the package for a subsequent piecing operation.

22. Apparatus according to claim 21, wherein stopping means controlled by respective yarn detectors for the yarn components serve to stop the package.

* * * * *